United States Patent [19]

Van Iperen

[11] Patent Number: 4,538,738

[45] Date of Patent: Sep. 3, 1985

[54] REMOVABLE GARMENT RACK FOR TRANSPORT OF HANGING GARMENTS

[75] Inventor: Willem H. P. Van Iperen, Westfield, N.J.

[73] Assignee: Sea-Land Corporation, Elizabeth, N.J.

[21] Appl. No.: 505,689

[22] Filed: Jun. 20, 1983

[51] Int. Cl.[3] ..... A47F 7/24

[52] U.S. Cl. ..... 211/162; 206/289; 211/118; 211/182; 312/321

[58] Field of Search ..... 211/123, 191, 113, 118, 211/125, 162, 182; 312/321, 257 SK; 248/226.4; 403/230, 233, 241; 206/289, 290, 291

[56] References Cited

U.S. PATENT DOCUMENTS

| | | | |
|---|---|---|---|
| 865,268 | 9/1907 | Powell | 312/321 X |
| 1,755,338 | 4/1930 | Smiley | 312/321 |
| 1,793,035 | 12/1927 | Whitney . | |
| 1,793,036 | 2/1928 | Shelf . | |
| 1,868,638 | 3/1931 | Mackey . | |
| 2,347,892 | 10/1941 | Derman . | |
| 2,357,309 | 12/1939 | Brown et al. . | |
| 2,425,875 | 4/1946 | Hermann . | |
| 2,466,728 | 3/1949 | Nampa . | |
| 2,513,348 | 1/1944 | Nampa . | |
| 2,542,964 | 7/1947 | Koett et al. . | |
| 2,613,615 | 3/1942 | Nampa . | |
| 2,659,319 | 11/1949 | Herman . | |
| 2,706,632 | 4/1955 | Chandler | 211/175 X |
| 2,806,436 | 8/1956 | Johnston . | |
| 2,893,545 | 3/1957 | Garfunkel . | |
| 2,904,190 | 12/1954 | Gidwitz et al. . | |
| 2,944,676 | 7/1960 | Bell | 211/191 |
| 3,095,830 | 7/1960 | Runken . | |
| 3,115,102 | 10/1959 | Rolfe, Jr. et al. . | |
| 3,197,267 | 7/1965 | Duff | 211/182 X |
| 3,302,800 | 10/1965 | Zdanowski . | |
| 3,318,460 | 7/1965 | Becker . | |
| 3,338,433 | 8/1967 | Mattson et al. | 211/182 X |
| 3,352,595 | 9/1965 | Bezlaj . | |
| 3,430,759 | 3/1969 | Radel et al. | 312/321 X |
| 3,519,139 | 3/1968 | Brennan . | |
| 3,563,182 | 8/1968 | MacFarlane et al. . | |
| 3,800,960 | 5/1972 | Collin . | |
| 4,265,577 | 5/1979 | Loomis . | |
| 4,357,059 | 11/1982 | Mittelmann | 211/113 X |

OTHER PUBLICATIONS

G. Van European Design.
K-Line System.
Hanjin System.

*Primary Examiner*—Robert W. Gibson, Jr.
*Attorney, Agent, or Firm*—Scully, Scott, Murphy & Presser

[57] ABSTRACT

A removable garment rack for transportation of hanging garments in a movable enclosure in which a pair of spaced-apart guide rails have a horizontal longitudinally-extending ledge for supporting a plurality of transversely extending garment supporting rails which are releasably retained on the guide rails for supporting garments.

11 Claims, 4 Drawing Figures

REMOVABLE GARMENT RACK FOR TRANSPORT OF HANGING GARMENTS

The present invention relates to a removable garment rack for transportation of hanging garments in a movable container in which the garment supporting rails are removable through releasable garment rail retaining means.

BACKGROUND AND OBJECTIVES OF THE PRESENT INVENTION

Various types of garment hanging devices have been devised for closets, containers including freight handling or loading utilizing adjustable braces of various types as disclosed in U.S. Pat. Nos. 1,793,035; 1,793,036; 2,347,892; 2,357,309; 2,425,875; 2,466,728; 2,513,348; 2,542,964; 2,613,615; 2,659,319; 2,893,545; 2,904,190; 3,095,830; 3,115,102; 3,302,800; 3,318,460; 3,352,595; 3,519,139; 3,563,182; 3,784,023; 3,800,960; 4,033,268; and 4,265,577, among others.

However, in the transportation of garments from a manufacturer to distant locations in substantial quantities, as well as transportation of hanging garments shipped in large quantities, including overseas shipments, the handling and packaging have been a substantial problem to protect the hanging garments from damage and to preserve and protect them as well as possible without further processing to the ultimate destination. Utilization of polyethylene bags and hangers of various types have been employed along with tie-ropes rather than package the garments in individualized containers in a suspended or hanging condition. Nevertheless, the present systems and devices utilized have been costly and have not met with universal acceptance due in part to the high cost of handling, time consuming packaging, and damage to the garments as well as pilferage during transportation from one location to another, among other reasons.

Therefore, it is an objective of the present invention to provide a removable garment rack for the transportation of hanging garments in a movable protective enclosure by removably installing garment supporting rails that usually extend overhead and installing them so they may be readily installed and removed to accommodate a maximum hanging load of garments which may be supported in spaced relation to each other throughout a movable enclosure with minimum additional protection during transportation from one location to another while remaining protected from the elements and pilferage.

Still another objective of the present invention is to utilize removable and adjustably locatable garment supporting rails that may be installed readily in a movable enclosure by utilizing releasable retaining means to support the garment rails on overhead guide rails that are fixed in position in a movable enclosure.

A still further objective of the present invention is the installation of a removable garment rack for transportation of hanging garments in a container in which the side walls are provided with longitudinally-extending ledges that are mounted adjacent to the roof of the structure and to which ledges removable garment supporting rails may be releasably fastened that extend transversely across the container for supporting hanging garments mounted on the garment rails and in which the garment rails may be readily installed and removed depending upon the cargo in the container.

It is yet another objective of the present invention to utilize removable garment racks for transportation of hanging garments in smaller vehicles by utilizing spaced-apart overhead guide rails having horizontal longitudinally-extending ledges to which transversely extending garment supporting rails may be releasably fastened for supporting hanging garments in the movable enclosure.

Other objectives and many of the attendant advantages of this removable garment rack for transportation of hanging garments in enclosures will become more readily apparent to those skilled in the pertinent arts upon consideration of the detailed specification, drawings, and claims in which modifications and equivalents are contemplated.

SUMMARY OF THE INVENTION

A removable garment rack for the transportation of hanging garments in a movable protective enclosure in which the enclosure incorporates a pair of spaced-apart overhead guide rails which provide a horizontal longitudinally-extending ledge. The longitudinally-extending ledge on each side of the enclosure will releasably support a plurality of transversely-extending garment supporting rails that reach between the longitudinally-extending ledges or guide rails. The individual guide rails are cooperatively and releasably retained on the longitudinally-extending ledges by suitable fastening means in the end sections that engage and are supported by the longitudinally-engaging ledges. Garments may be supported on hangers or other means on the garment supporting rails in substantial quantities and further protected within an enclosure from the elements by suitable protective coverings including polyethylene bags.

DETAILED DESCRIPTION OF PREFERRED EMBODIMENT OF THE INVENTION

Figure 1:
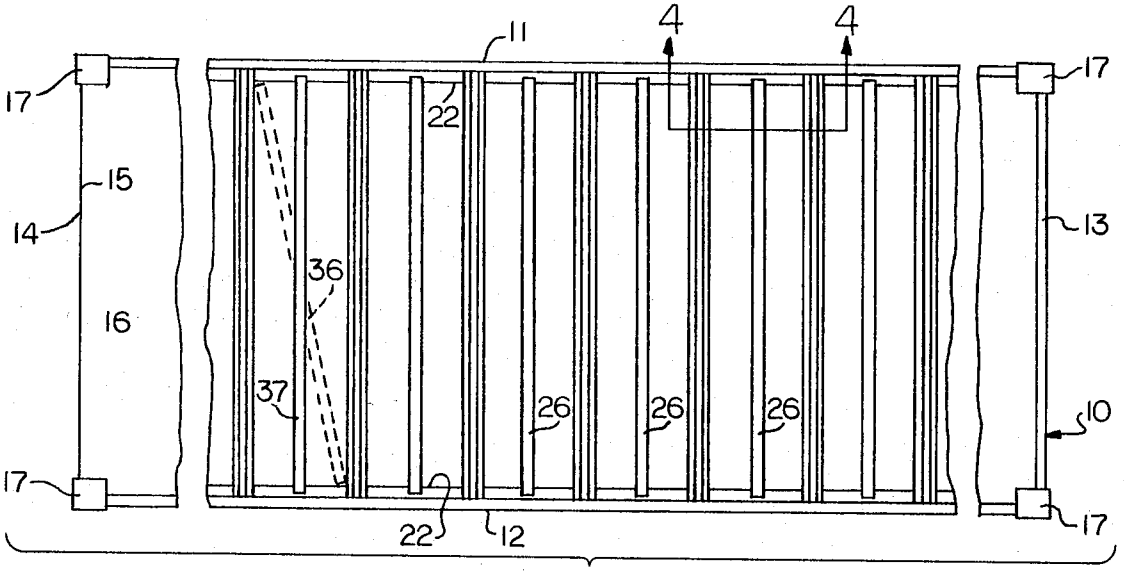
FIG. 1 is a bottom plan view, with portions removed, of a container viewed from the interior illustrating a series of garment supporting rails positioned on spaced-apart guide rails with one garment supporting rail shown in outline form prior to installation.
Figure 2:
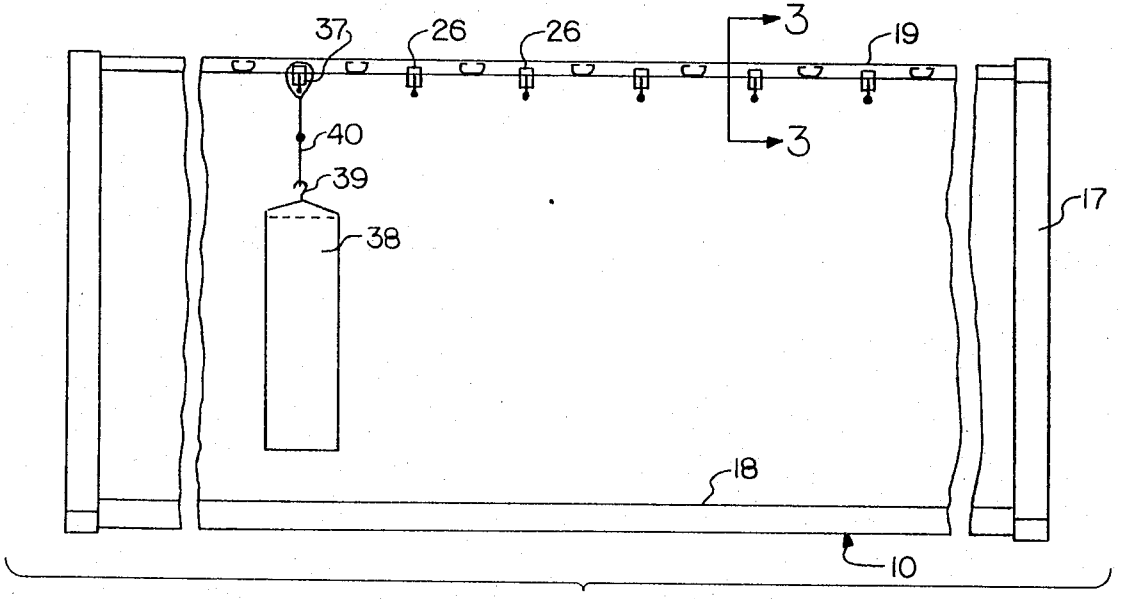
FIG. 2 is an interior elevational view of a side of a container, with portions removed, illustrating the positioning of a series of spaced-apart garment supporting rails with one system for supporting garments from a garment supporting rail.

There is illustrated in FIGS. 1 and 2 a cargo container 10 of conventional construction as one type of enclosure for transporting bulk cargo which forms an enclosure for shipping and protecting cargo in transportation over land and aboard sea-going vessels. However, enclosed truck bodies as well as stationary installations may readily accommodate the removable garment rack for storing and transporting hanging garments with the container illustrated being only one form of protective enclosure. The container 10 is provided with side walls 11 and 12, end wall 13 and an openable rear wall 14 which is provided with conventional hinged doors 15 and 16 which open outwardly in a conventional manner. Suitable corner posts 17 are also provided at the corners of the container for reinforcement and lifting by appropriate lifting spreader means. The base or floor 18 of the container 10 has conventional reinforcing members and a floor plate providing throughout a weatherproof and watertight mobile enclosure which may be mounted and releasably locked on a suitable chassis to be drawn by a tractor in overland use. The individual containers 10 may be stacked vertically aboard ship or on a flat rail car.

Figure 3:
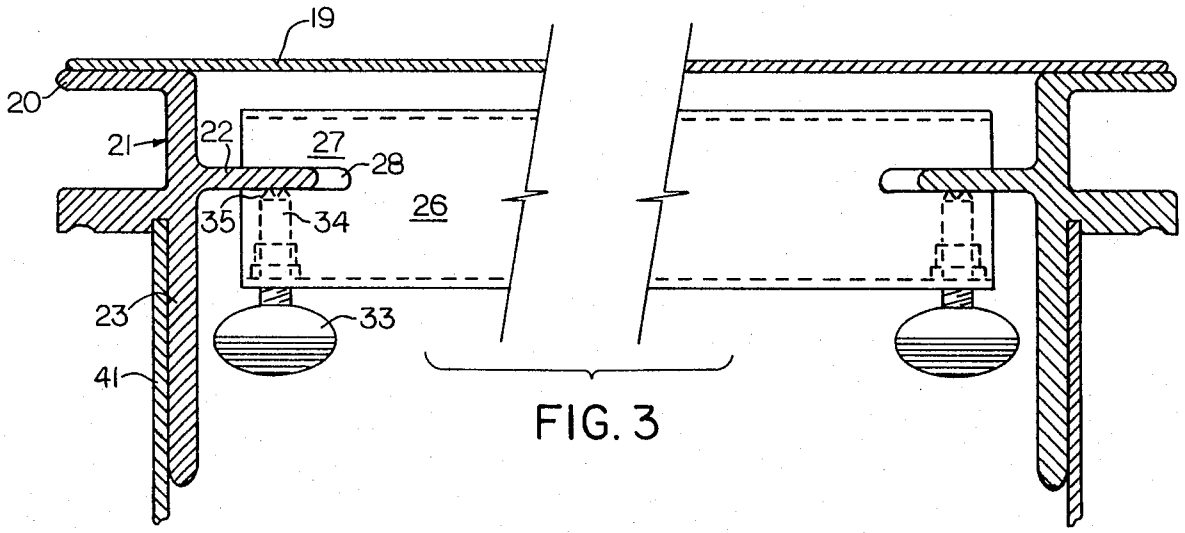
FIG. 3 is an enlarged partial sectional view taken substantially along line 3—3 of FIG. 2.

Roof sheathing 19, as shown in FIG. 3, is supported on the horizontal section 20 of an extruded aluminum casting 21 which extends longitudinally between a pair of corner posts 17 and is provided with a horizontal inwardly projecting longitudinally-extending ledge 22 spaced vertically from the outwardly projecting section 20. Projecting ledge 22 extends into the interior of the container vertically overhead and suitably spaced from the underside of the roof sheathing 19. The downwardly projecting leg 23 on casting 21 supports the side wall sheathing 41 which extends to the base or floor of the container in a conventional manner.

A series of longitudinally spaced-apart U-shaped roof bows 42 is connected by suitable fastening means such as rivets 24 to the ledge 22 with the inwardly extending foreshorted legs 25 that extend inwardly and horizontally support the roof sheathing 19 at suitable intervals to prevent buckling of the roof sheathing.

A series of spaced-apart transversely extending garment supporting rails 26 is mounted releasably to the projecting ledges 22 at each side of the container at suitable spaced intervals therebetween.

Figure 4:
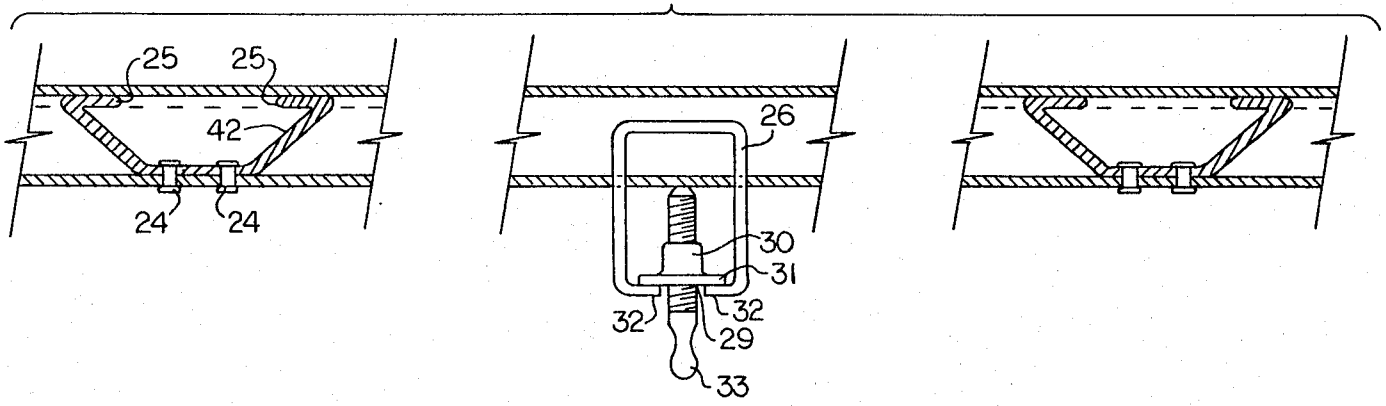
FIG. 4 is a partial enlarged sectional view, with portions removed, taken substantially along the lines of 4—4 of FIG. 1.

As shown in FIG. 3, each of the garment hanger rails or members 26 has an end section 27 which is provided with an elongated open end slot 28 for cooperatively receiving therein and supported thereon the inwardly projecting horizontal and longitudinally-extending ledge 22. The garment supporting rail 26 that extends transversely and horizontally beneath the roof 19 in the container is substantially rectangular in cross-section as shown in FIG. 4 and is provided with a bottom longitudinally-extending slot 29 in which the weld nut 30 is provided with a flared skirt 31 that may be welded or tacked into position on the inwardly projecting webs 32 of the rail 26. The weld nut 30 is preferably threaded to cooperatively receive the threaded thumb screw 33. The threaded end 34 of the thumb screw 33 has projections 35 when the thread is turned or pressed into the thumb screw 33 to at least partially penetrate in the locked position into the undersurface of the ledge 22 as shown in FIG. 3. The individual garment supporting rails 26 are foreshortened to facilitate installation in position and removal as shown in FIG. 3.

As illustrated in FIG. 1, the garment rail 36, before installation, is rotated during alignment of the slots 28 with the ledge projections 22 for ease of installation into the position illustrated by the installed garment hanger 37 comparable to the garment hangers 26. After positioning on the projecting ledges 22, the thumb screws 33 may be tightened to secure the garment rail in position before garments are suspended from the rails 26 as shown in FIG. 2. The garment bag 38 is supported on the hanger 39 which in turn is suspended from the flexible cord member 40 which in turn is wrapped around the garment rail 37. Restriction against movement or swaying of the hanging garments may be restricted depending upon the mode of transportation and loading.

A series of flexible cords 40 may be suitably linked or secured to each garment rail throughout the enclosure. Dunnage bags or suitable tie ropes may be employed, if necessary, depending upon the nature of the garments and the extent of loading within the container on each garment rail.

After shipment from one location to another, in the event the garment rails are no longer required for the type of cargo to be transported in the container, the garment rails may be readily removed and stored for future use or they may be kept in position for future use depending upon the next cargo loading.

If desirable, and depending upon the overall length of the garments being shipped, a second tier may be installed by utilizing a fabricated ledge spaced at a lower location than the ledge 22 that is overhead adjacent to the roof depending upon the length of the garments as will be readily apparent to one skilled in the art.

Although the garment rails 26 are illustrated as having a longitudinal slot 29, circular rails, continuous walled tubing as well as other structural configurations may be utilized to support the garments from the longitudinally-extending ledges within the container.

It has been determined from sample shipments that minimal damage has been encountered in the use of the present structure and that suitable tie strings may be utilized to prevent undue swaying of the garments within the container depending upon the size and shape of the loading.

I claim:

1. A modular and stackable cargo container having a removable garment rack for transportation of hanging garments, (a) a modular and stackable cargo container having a reinforced floor and corner posts, at least one door, said walls and a roof to define an enclosed container, (b) a pair of inwardly extending longitudinal ledges adjacent the roof and extending inwardly from a pair of opposing side walls, (c) a pair of overhead guide rails extending between said corner posts for supporting said longitudinal ledges and said roof, (d) a plurality of removable and adjustable garment rails having first and second end sections, said rails being spaced apart and extending traversely across said container between said pair of inwardly extending ledges, each of said end sections having a slot therein for engaging the longitudinal ledge, (e) a releasable securing means mounted at each of said end sections to releasably secure said garment rails to said ledges, whereby said garment rails may be traversely and adjustably spaced along the longitudinal dimension of said container to maximize the number of hanging garments when transporting garments; and quickly and easily removed to allow the entire cross section of the container to be filled with bulk goods.

2. A modular and stackable container as claimed in claim 1 wherein the longitudinal ledges are formed as an integral part of said overhead guide rails.

3. A modular and stackable container as claimed in claim 2 wherein each of said overhead guide rails is an aluminum casting.

4. A modular and stackable container as claimed in claim 1 wherein each of said garment rails is formed with a complementary slot that corresponds to the cross section of the inwardly extending longitudinal ledge.

5. A modular and stackable container as claimed in claim 4 wherein said releasable securing means comprises a thumb screw for engaging said ledge and clamping it to an opposing side of said slot.

6. A modular and stackable container having a removable garment rack for transportation of hanging garments, said container comprising (a) a modular and stackable container having a reinforced floor and corner posts, a pair of doors at one end thereof, and an opposing end wall, side walls and roof to form an enclosed container, (b) a pair of overhead guide rails extending between said corner posts for supporting said roof and side walls, said guide rails defining an inwardly extending longitudinal ledge adjacent to said roof on opposing side walls of the container, (c) a plurality of removable and adjustable garment rails having first and second end sections, said rails being spaced apart and extending traversely across said container between said pair of inwardly extending ledges, each of said end sections having a slot therein for engaging the longitudinal ledge, (d) a releasable securing means mounted in each of said end sections to releasably secure said garment rails to said ledgers, whereby said garment rails may be traversely and adjustably spaced along the longitudinal dimesion of said container to maximize the number of hanging garments when transporting garments; and quickly and easily removable to enable the entire cross section of the container to be used for the transport of bulk goods.

7. A modular and stackable container as claimed in claim 6 wherein the overhead guide rails and its associated longitudinal ledge is formed of an integral casting.

8. A modular and stackable container as claimed in claim 7 wherein each of the said garment rails is formed with a complementary slot that corresponds to the cross section of the inwardly extending ledge.

9. A modular and stackable container as claimed in claim 8 wherein each of the garments rails of rectangular cross section with a transverse slot extending through opposing side walls of said rail.

10. A modular and stackable container as claimed in claim 9 wherein said releasable securing means comprises a thumb screw for engaging said ledge and clamping it to an opposing side of transverse slot.

11. A modular and stackable container as claimed in claim 6 wherein said roof further comprises support bows that are supported by the longitudinal ledge portion of said upper guide rail, with one or more of the garment rails positioned between each support bow.

* * * * *

UNITED STATES PATENT OFFICE

CERTIFICATE OF CORRECTION

Patent No. 4,538,738 Dated September 3, 1985

Inventor(s) Willem H.P. Van Iperen

It is certified that error appears in the above-identified patent and that said Letters Patent are hereby corrected as shown below:

Column 1, line 16: "U.S. Pat. Nos." should read --U.S. Patents--,

IN THE CLAIMS:

Column 4, line 37: "said walls" should read --side walls--,

Column 6, line 22: "side of transverse slot" should read --side of said transverse slot--.

Signed and Sealed this

*Fifth* Day of *August 1986*

[SEAL]

*Attest:*

DONALD J. QUIGG

*Attesting Officer*

*Commissioner of Patents and Trademarks*